US007346959B2

(12) United States Patent
Heid

(10) Patent No.: US 7,346,959 B2
(45) Date of Patent: Mar. 25, 2008

(54) HINGE

(75) Inventor: George E. Heid, Rockford, IL (US)

(73) Assignee: Newell Operating Company, Atlanta, GA (US)

( * ) Notice: Subject to any disclaimer, the term of this patent is extended or adjusted under 35 U.S.C. 154(b) by 187 days.

(21) Appl. No.: 11/084,263

(22) Filed: Feb. 25, 2005

(65) Prior Publication Data

US 2005/0193521 A1 Sep. 8, 2005

Related U.S. Application Data

(60) Provisional application No. 60/555,223, filed on Mar. 22, 2004, provisional application No. 60/548,845, filed on Feb. 27, 2004.

(51) Int. Cl.
*E05D 7/04* (2006.01)

(52) U.S. Cl. ..... 16/242; 16/245; 16/271

(58) Field of Classification Search ..... 16/243–245, 16/248, 299–301, 236–238, 257, 259, 271, 16/241, 242, 258, 264, 271 X
See application file for complete search history.

(56) References Cited

U.S. PATENT DOCUMENTS

| | | | | |
|---|---|---|---|---|
| 375,038 | A | 12/1887 | Wright | |
| 375,039 | A | 12/1887 | Wright | |
| 386,186 | A | 7/1888 | Dahlman | |
| 794,454 | A | 7/1905 | Davis et al. | |
| 880,317 | A | 2/1908 | Von De Marwitz | |
| 928,760 | A | 7/1909 | Hunter | |
| 1,002,394 | A | 9/1911 | Hanson | |
| 1,111,832 | A | 9/1914 | Hazelrigg et al. | |
| 1,214,263 | A * | 1/1917 | Barber | 16/258 |
| 1,314,732 | A | 9/1919 | Cochran et al. | |
| 2,373,955 | A | 4/1945 | Fuller | |
| 2,474,311 | A * | 6/1949 | Graham | 220/843 |
| 2,913,200 | A * | 11/1959 | Paine, Jr. et al. | 248/637 |
| 2,940,115 | A | 6/1960 | Hansen | |
| 3,423,786 | A * | 1/1969 | Arias, Jr. et al. | 16/257 |
| 3,618,993 | A * | 11/1971 | Platte | 52/713 |
| 3,728,758 | A * | 4/1973 | Johansen | 16/257 |
| 3,965,532 | A * | 6/1976 | Wigfall | 16/270 |
| 4,106,158 | A | 8/1978 | Kellems et al. | |
| 4,141,109 | A | 2/1979 | Farrell | |
| 4,142,272 | A | 3/1979 | Oogami et al. | |
| 4,159,548 | A * | 7/1979 | Hewson | 4/236 |
| 4,304,027 | A | 12/1981 | Di Fazio | |
| 4,330,901 | A | 5/1982 | Sanders | |
| 4,386,646 | A | 6/1983 | Matyas | |
| 4,434,523 | A | 3/1984 | Grass | |

(Continued)

FOREIGN PATENT DOCUMENTS

BE 1008840 A3 * 8/1996

(Continued)

*Primary Examiner*—Chuck Y. Mah
(74) *Attorney, Agent, or Firm*—Banner & Witcoff, Ltd.

(57) ABSTRACT

A hinge for a door is disclosed. The hinge comprises a receiver assembly having a slot, a door leaf having a retaining spring biased away from the door leaf, the door leaf being dimensioned for insertion into the slot and a retaining device associated with the receiver assembly for releasably engaging the retaining spring to releasably retain the door leaf in the slot.

15 Claims, 15 Drawing Sheets

U.S. PATENT DOCUMENTS 4,493,129 A 1/1985 Grass
4,571,774 A 2/1986 Hinson
4,639,971 A 2/1987 Kurtz
4,646,472 A 3/1987 Sugawara
4,696,078 A 9/1987 Stromquist
4,703,539 A 11/1987 Lautenschlager, Jr. et al.
4,748,717 A 6/1988 Osborne
4,776,061 A 10/1988 Franco
4,785,498 A 11/1988 Brotschi
4,815,162 A 3/1989 McAteer
4,825,507 A 5/1989 Killingstad
4,837,893 A 6/1989 Wilson
4,893,863 A 1/1990 Skonieczny et al.
4,925,507 A 5/1990 Yamaguchi
4,937,916 A 7/1990 Redman
4,985,939 A 1/1991 Otte
5,029,363 A 7/1991 Hesener
5,056,190 A 10/1991 Rock et al.
5,058,236 A 10/1991 Henson
5,074,609 A 12/1991 Dear
5,088,155 A * 2/1992 Grass ..... 16/257
5,133,109 A 7/1992 Mariani
5,144,721 A 9/1992 Schade
5,193,308 A * 3/1993 Davidian ..... 49/381
5,283,929 A 2/1994 Lin
5,339,493 A 8/1994 MacIntyre
5,379,487 A 1/1995 Bowers
5,419,640 A 5/1995 Doring
5,694,665 A 12/1997 Strickland et al.
5,701,636 A 12/1997 Jahnke
5,713,105 A 2/1998 Toomey
5,755,011 A 5/1998 Green et al.
5,799,370 A 9/1998 Davidian et al.
5,806,144 A 9/1998 Fries
6,049,946 A 4/2000 Cress et al.
6,134,750 A 10/2000 Salice
6,202,255 B1 3/2001 Sitter
6,212,734 B1 4/2001 Commons
6,397,432 B1 6/2002 di Vinadio
6,484,363 B1 11/2002 Chung
6,516,494 B2 2/2003 Nakamoto et al.
6,643,895 B1 11/2003 Domenig et al.
6,647,591 B1 11/2003 Domenig et al.
6,715,181 B1 * 4/2004 Fries ..... 16/271
2002/0166207 A1 11/2002 Egger et al.
2003/0066164 A1 4/2003 Domenig
2004/0240933 A1 * 12/2004 Schwarz et al. ..... 403/316

FOREIGN PATENT DOCUMENTS

GB 679658 9/1952
GB 911559 11/1962
GB 1045702 10/1966
JP 3-187486 8/1991
JP 08110152 A * 4/1996
WO WO 9010775 A1 * 9/1990

* cited by examiner

HINGE

CROSS-REFERENCE TO RELATED APPLICATIONS

The present application claims the benefit of provisional patent application No. 60/548,845, filed in the United States Patent and Trademark Office on Feb. 27, 2004, and provisional patent application No. 60/555,223, filed in the United States Patent and Trademark Office on Mar. 22, 2004.

FEDERALLY SPONSORED RESEARCH OR DEVELOPMENT

Not Applicable.

TECHNICAL FIELD

This invention relates to an adjustable hinge system, such as for a door.

BACKGROUND OF THE INVENTION

Adjustable hinges are desirable, as they permit adjustment as needed such as when a house settles. Typically such adjustable hinges have been complicated and have required multiple fastening components.

DETAILED DESCRIPTION OF A PREFERRED EMBODIMENT

Figure 1:
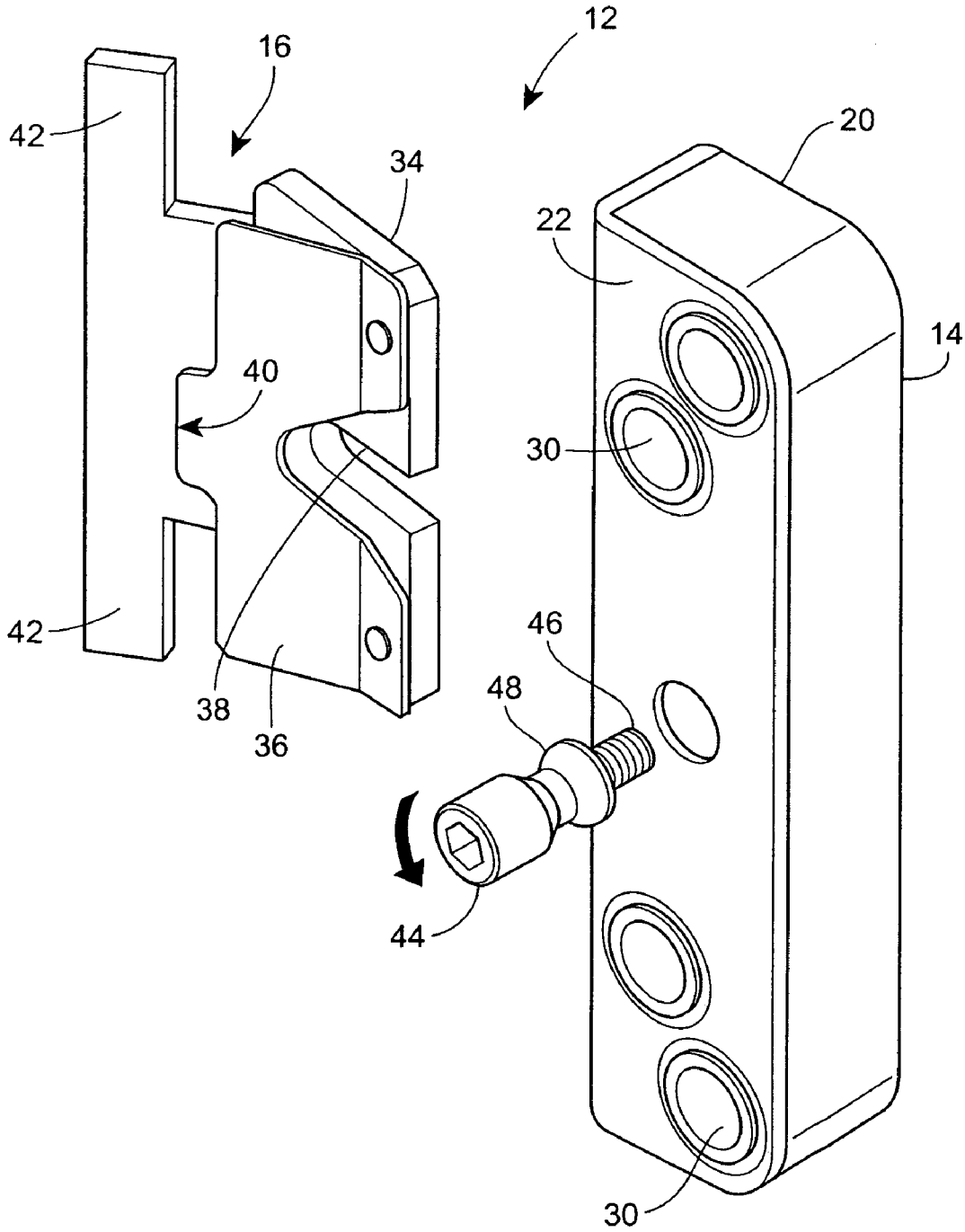
FIG. 1 is a perspective view of one embodiment of an adjustable hinge of the present invention.
Figure 2:
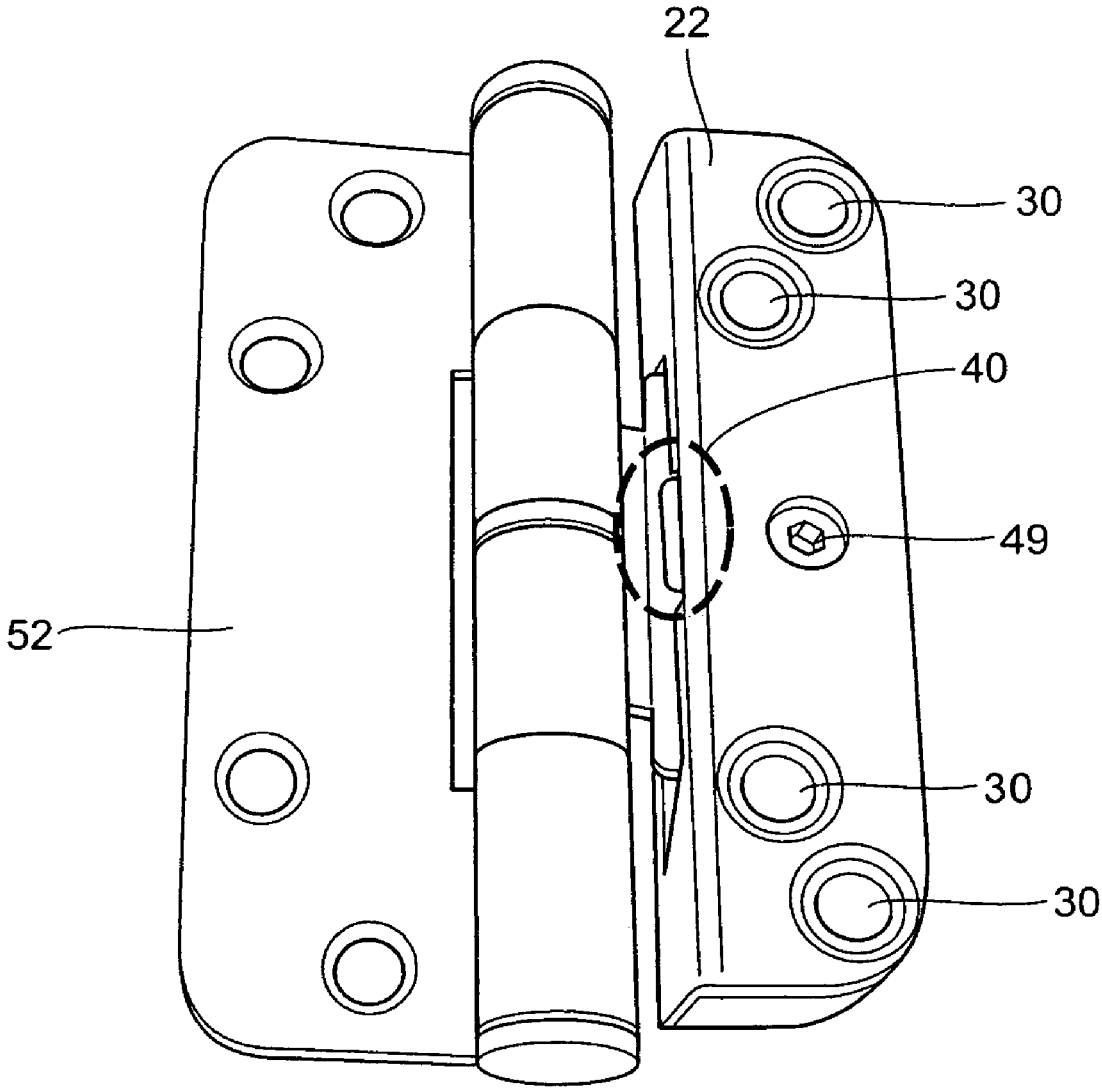
FIG. 2 is a front view of the adjustable hinge of FIG. 1.
Figure 3:
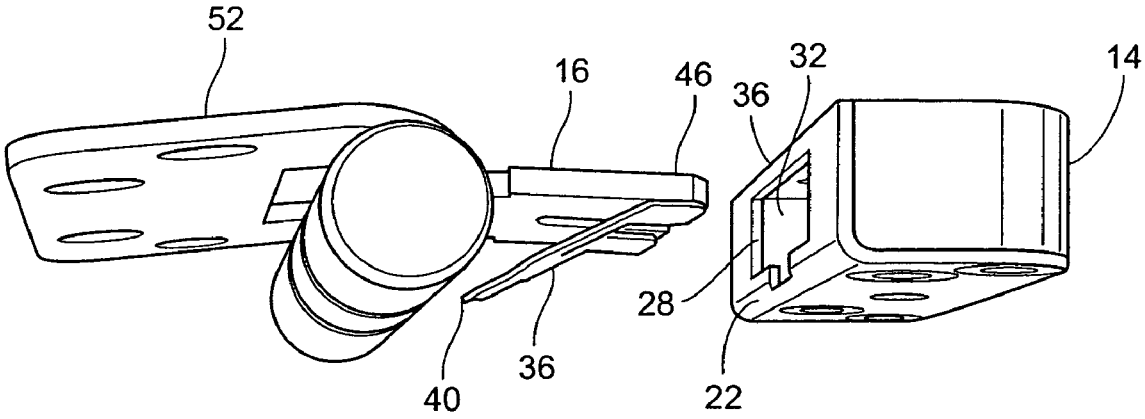
FIG. 3 is a generally top view of the hinge of FIG. 1.
Figure 4:
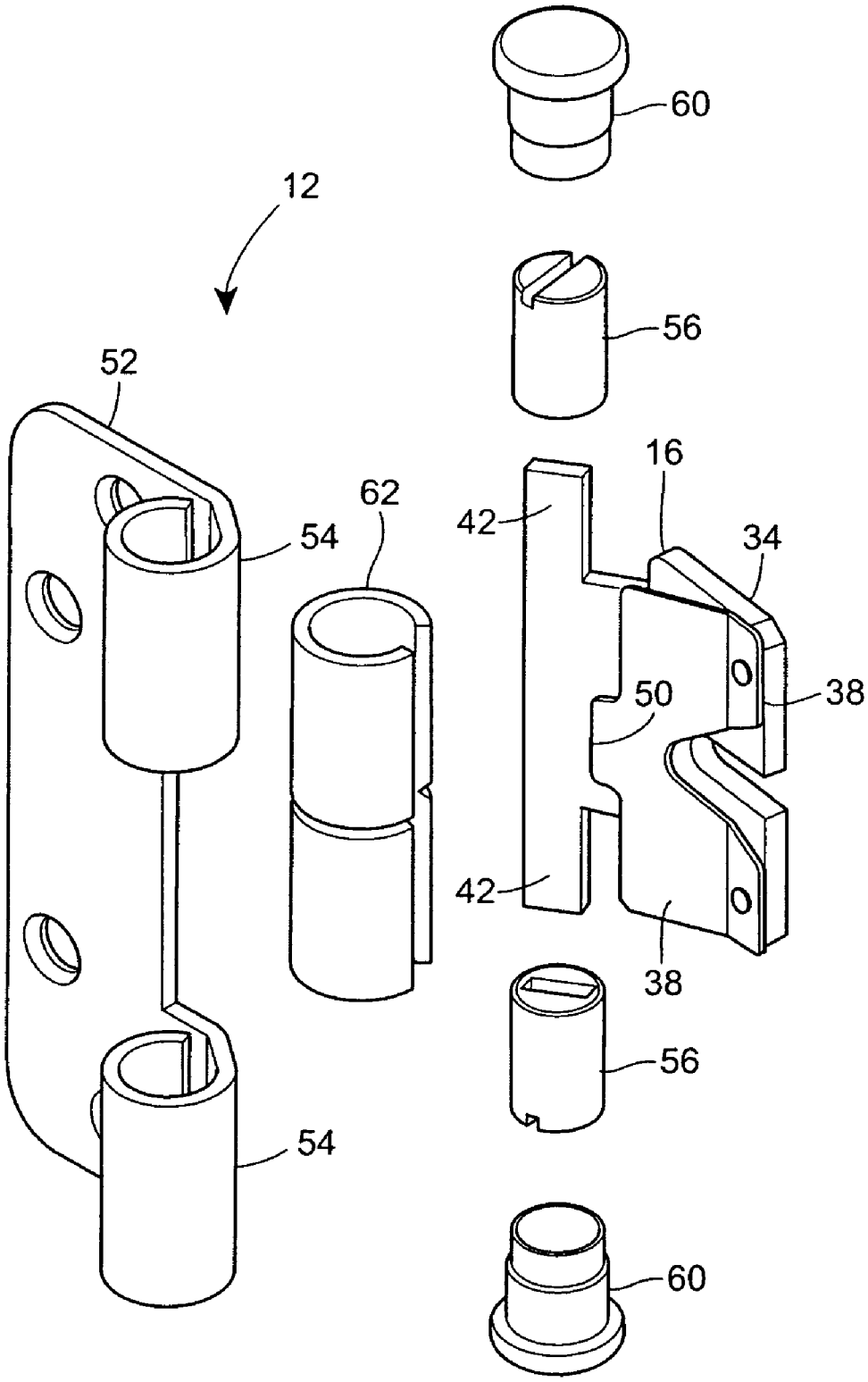
FIG. 4 is an exploded view of the hinge of FIG. 1, which hinge is not vertically adjustable.
Figure 5:
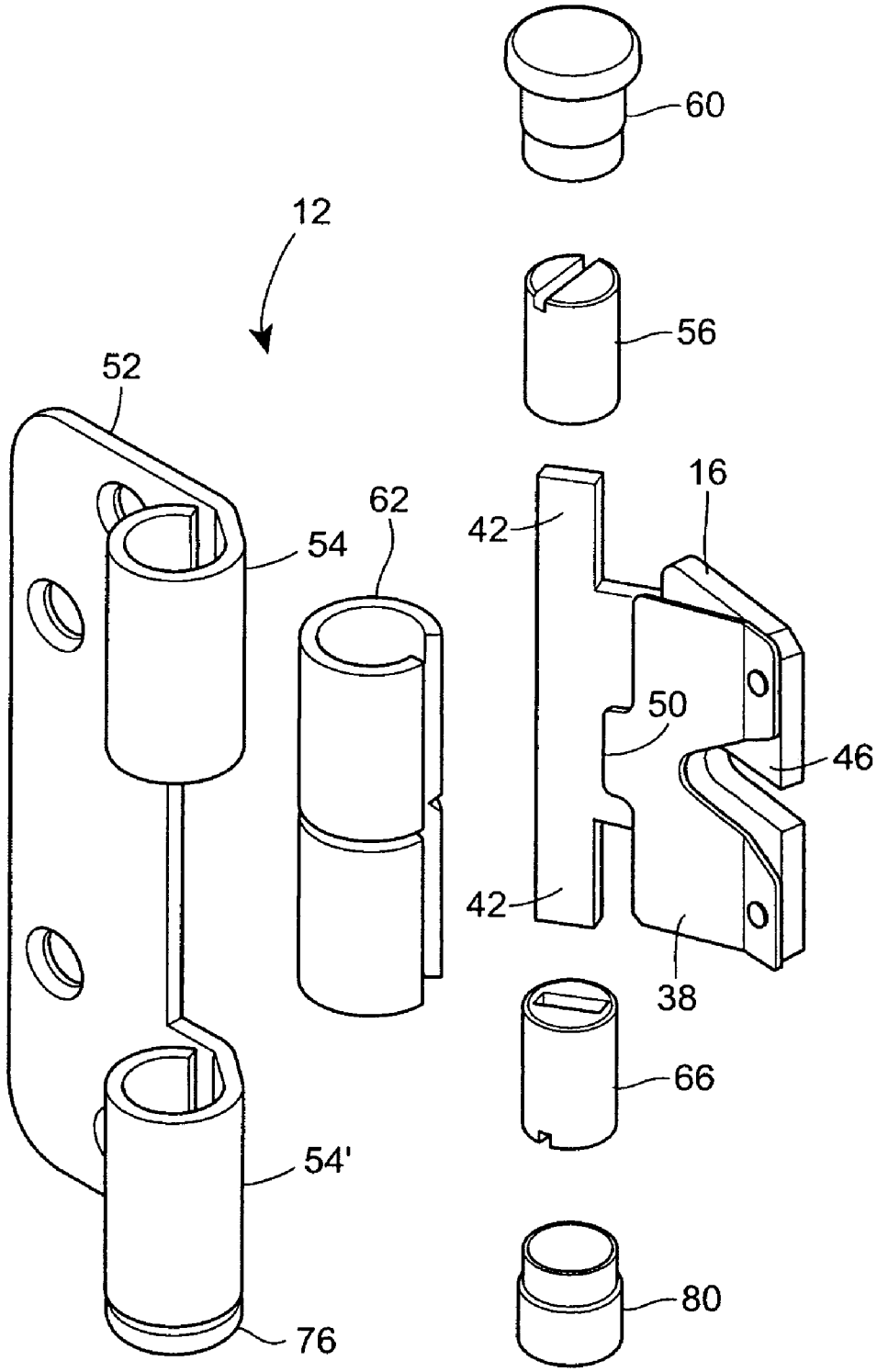
FIG. 5 is an exploded view of a the hinge of FIG. 1, which hinge is vertically adjustable.
Figure 6:
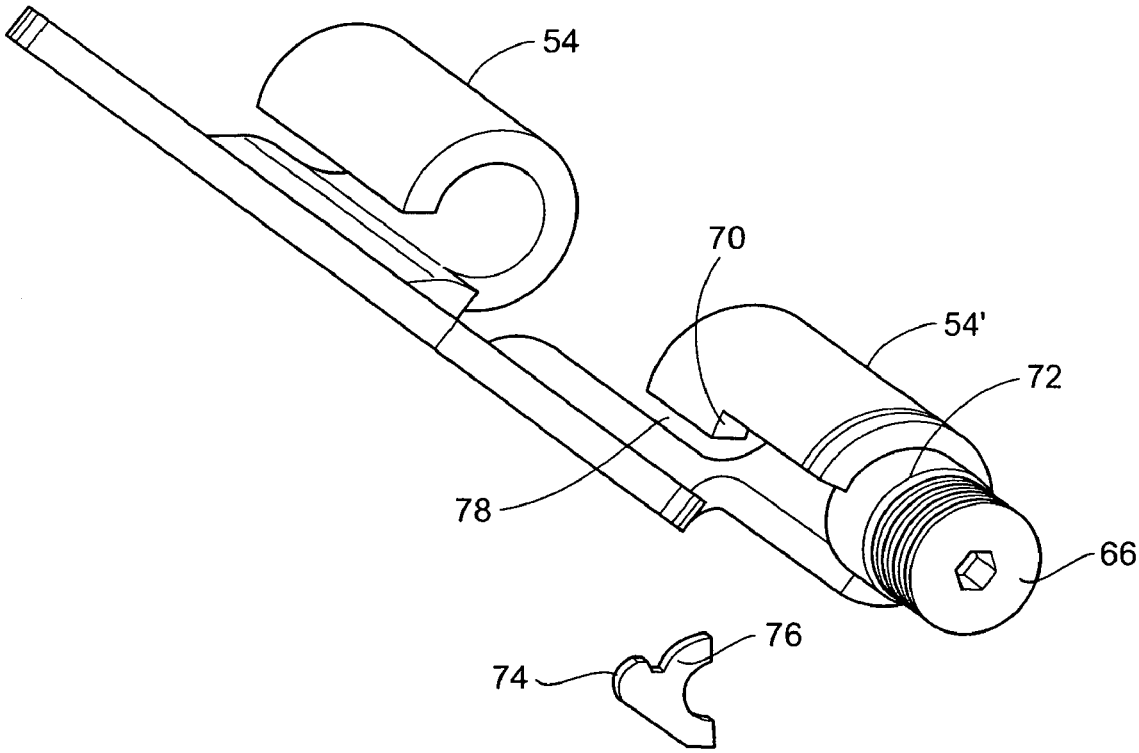
FIG. 6 is a perspective view of a frame wing of the vertically adjustable hinge of FIG. 5.
Figure 7:
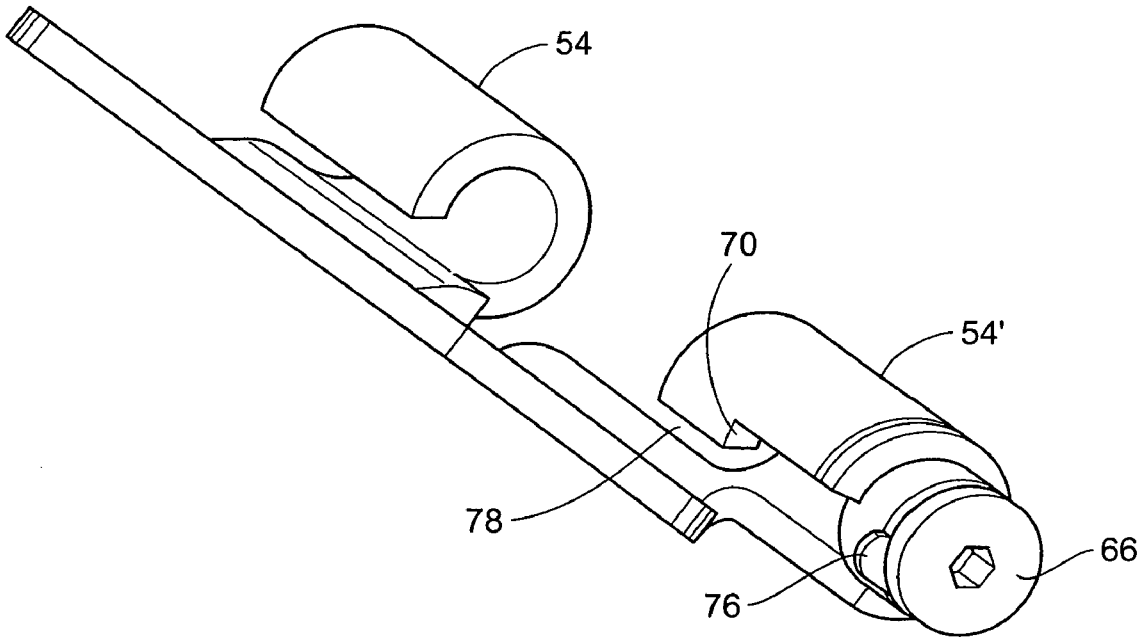
FIG. 7 is a further perspective view of a frame wing of the vertically adjustable hinge of FIG. 5.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A first embodiment of a horizontally adjustable hinge 12 is illustrated in FIGS. 1-4. The hinge 12 includes a receiver assembly 14 and a steel door leaf 16. The receiver assembly 14 includes a die cast housing 20 and a steel or brass cover 22. The housing 20 has a tapered slot 24 extending from a housing opening 26. The cover 22 has a slotted opening 28 aligned with, but slightly smaller than, the housing opening 32. The receiver assembly 14 includes four aligned holes 30 to receive screws (not shown) to secure the receiver assembly 14 to a door (not shown).

The door leaf 16 includes a slotted leaf 34 and a retaining spring 36. The retaining spring 36 is attached to, and extends from, the slotted leaf 34. The slotted leaf 34 has a leaf slot 38. The retaining spring 36 terminates with a release tab 40. The door leaf 20 further includes first and second opposed posts 42.

The slotted leaf 34 is inserted into the tapered housing slot 24. As the slotted leaf 34 is inserted, the retaining spring 36 is squeezed by the cover opening 28, until the spring 36 passes the cover opening 28, at which time the spring 36 expands, locking the slotted leaf 34 in the tapered slot 24. The slotted leaf 34 can be removed by depressing the tab 40, such as with a screw driver.

The hinge 12 includes an adjustment screw 44. The adjustment screw 44 includes a threaded portion 46 and a circumferential grooved portion 48. The threaded portion 46 is screwed into a cooperatively threaded hole 50 in the housing 20.

As the slotted leaf 34 is inserted into the tapered housing slot 24, the leaf slot 38 captures the grooved portion 48 of the adjustment screw 44. Rotation of the adjustment screw 44, such as with an Allen wrench, axially moves the adjustment screw 44, thereby horizontally moving the door leaf 16.

The hinge 12 further includes a steel frame wing 52 for attachment to a door frame (not shown). The frame wing 52 includes first and second opposed knuckles 54. Bearings 56 are placed over the first and second posts 42, which are then placed into respective first and second knuckles 54. Decorative steel end caps 60 are placed over outer openings of the knuckles 54. A decorative steel shroud 62 is disposed between the knuckles 54.

The hinge 12 can also be vertically adjustable, as illustrated in FIGS. 5-8.

To make the hinge 12 vertically adjustable, the bottom one of the knuckles 54' is internally threaded to receive an externally threaded vertical positioning screw 66. Rotation of the vertical positioning screw 66 vertically adjusts the door leaf 34 relative to the frame wing 52. The decorative end cap 60 is placed over the opening of the other knuckle 54. Which knuckle is threaded depends upon whether the hinge is to be a right hand hinge or a left hand hinge.

Such vertical adjustment systems are known, but have been subject to a problem of having the vertical positioning screw 66 lock when it is rotated past the threads of the threaded knuckle 54'.

Figure 8:
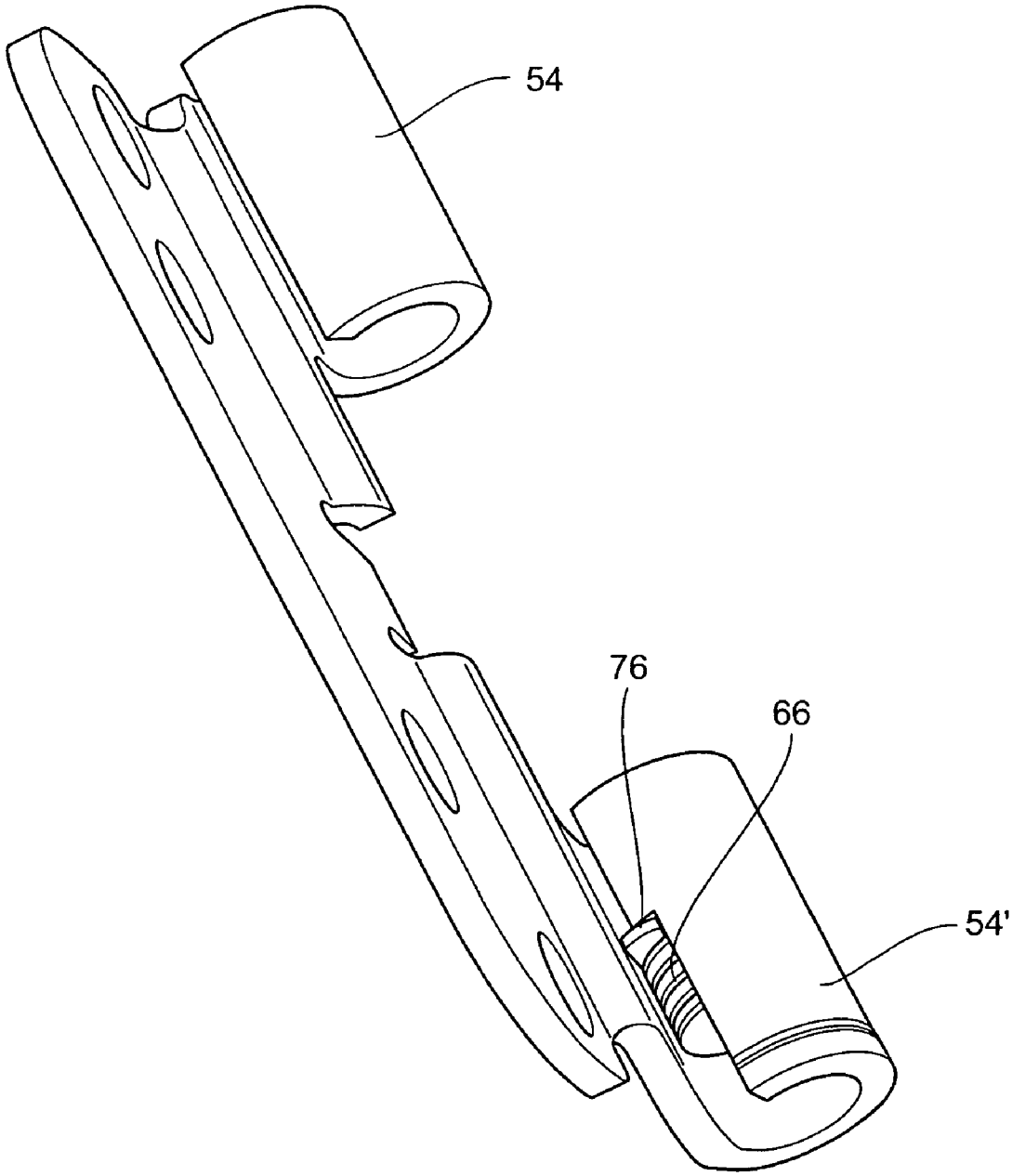
FIG. 8 is a further perspective view of a frame wing of the vertically adjustable hinge of FIG. 5.
Figure 9:
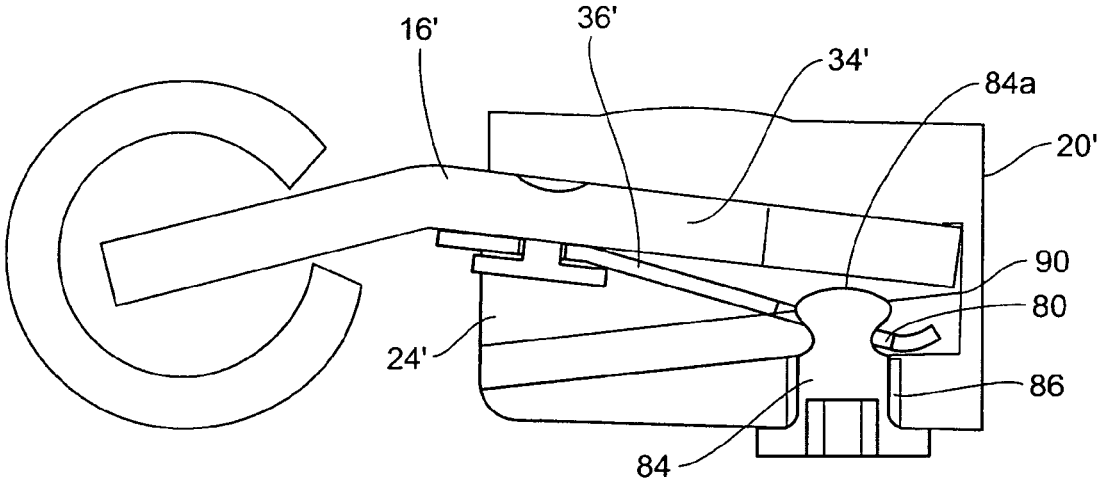
FIG. 9 is a sectional view of a hinge having an alternative arrangement for securing the door leaf to the housing.
Figure 10:
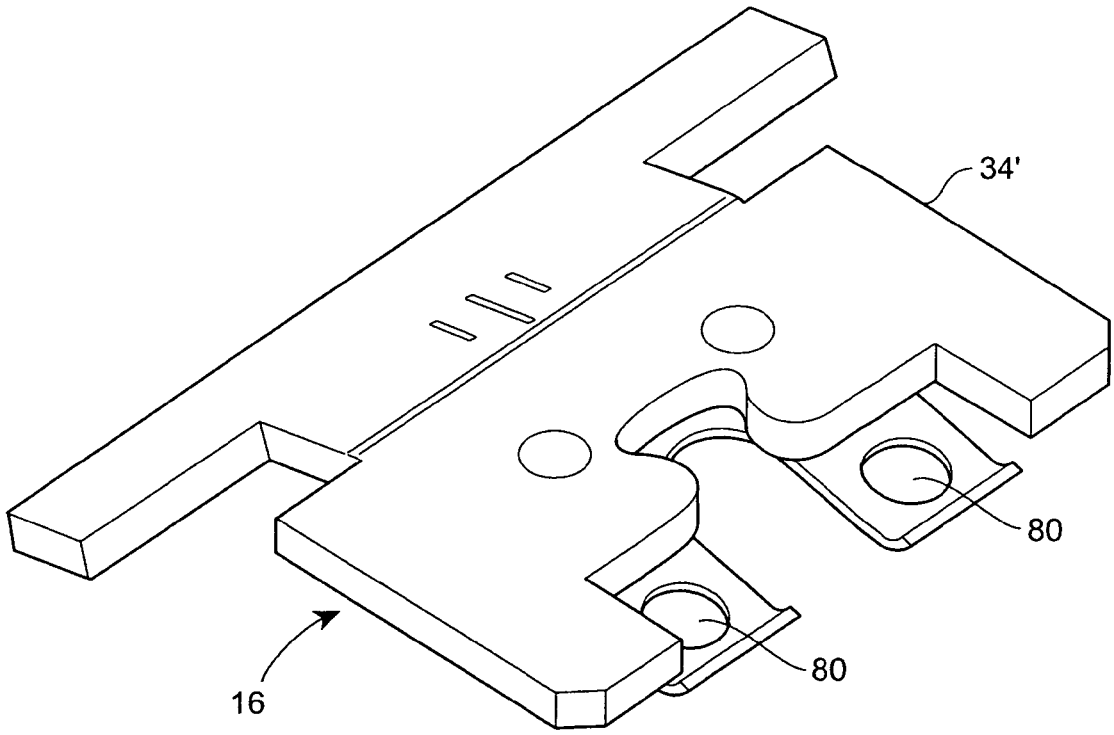
FIG. 10 is a perspective view of a door leaf of the embodiment of FIG. 9.

In accordance with this aspect of the invention, the threaded knuckle 54' is provided with a stop surface 70. The vertical positioning screw 66 includes a circumferential groove 72, which receives a wing stop 74. The wing stop 74 is preferably formed of steel, and includes a stop tab 76. As the vertical positioning screw 66 is rotated into the threaded knuckle 54', the stop tab 76 travels along a knuckle slot 78, until the stop tab 76 ultimately engages, and is blocked by, the stop surface 70, as illustrated in FIG. 8.

Figure 11:
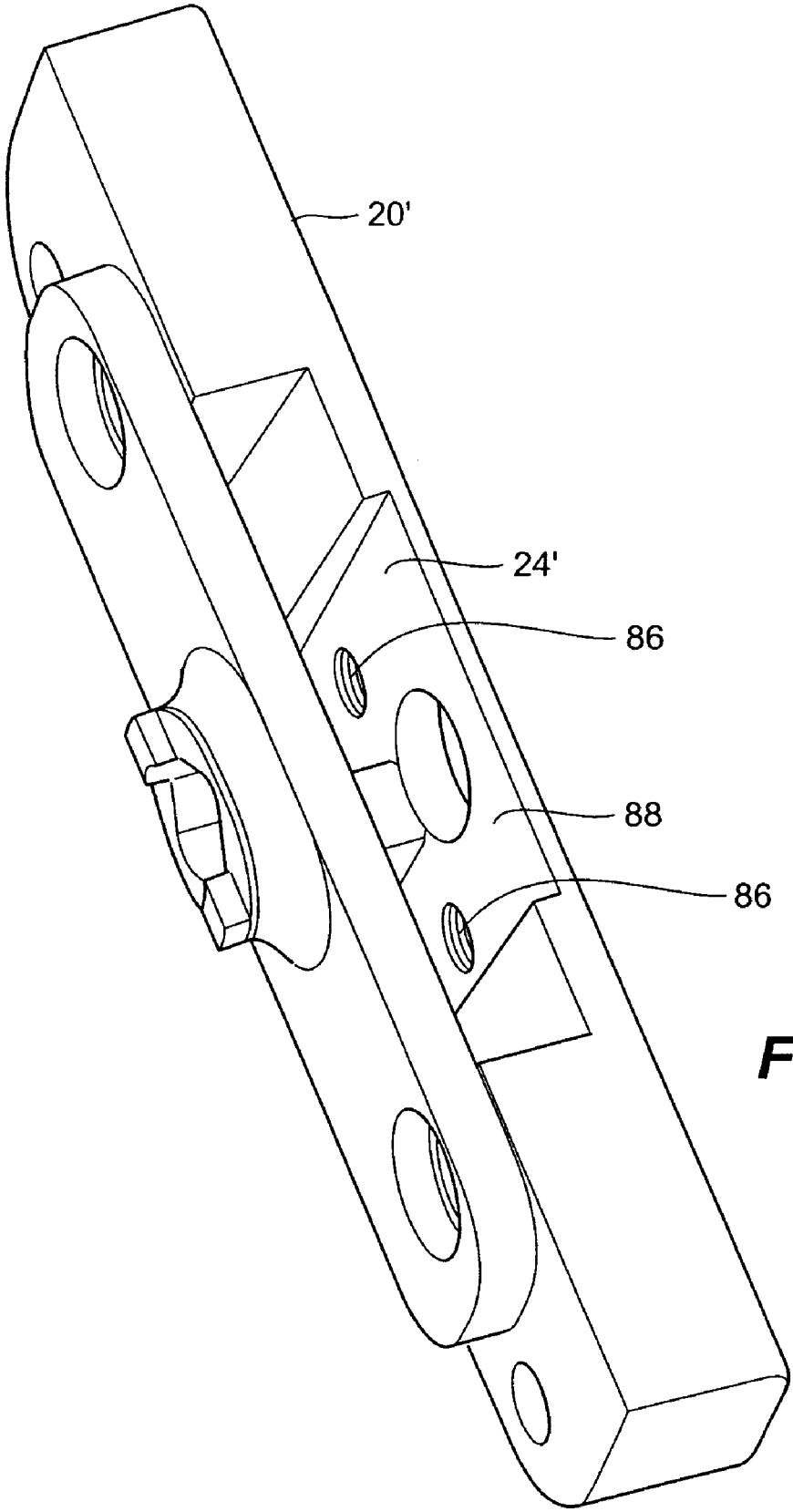
FIG. 11 is a perspective view of a spring pocket of the embodiment of FIG. 9.
Figure 12:
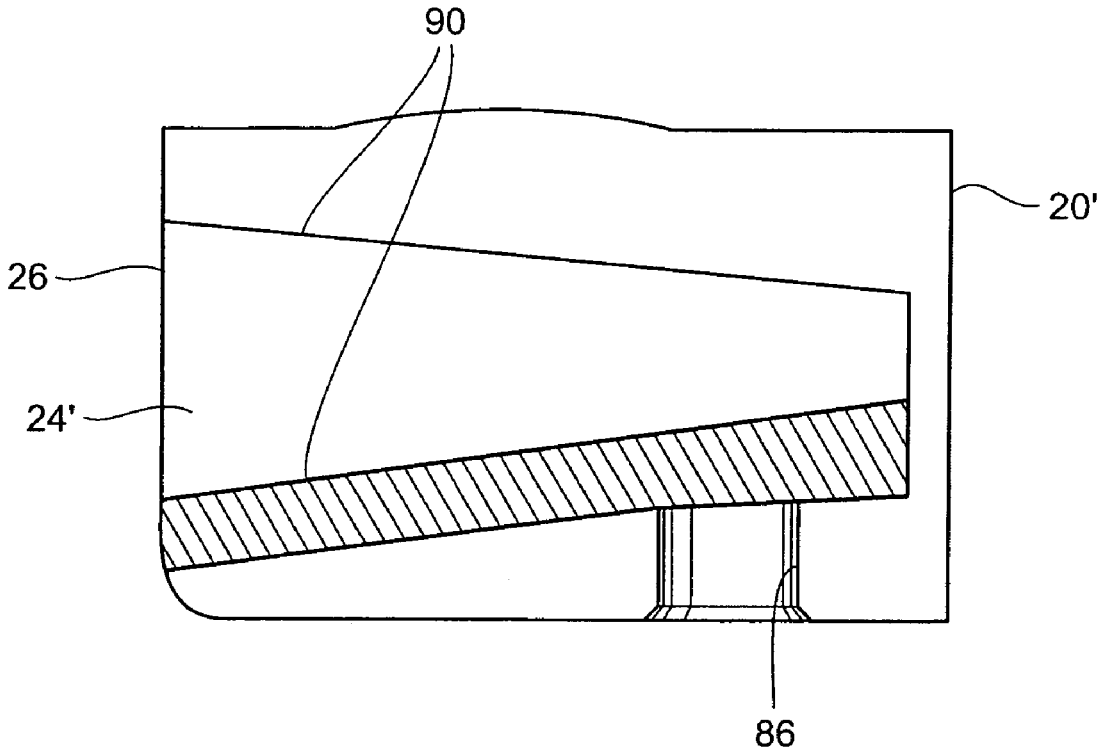
FIG. 12 is a sectional view of a spring pocket of the embodiment of FIG. 9.

A second embodiment of a system for retaining a door leaf 16' in a modified housing 20', using a modified retaining spring 36", having spring apertures 80, is illustrated in FIGS. 9-12. As discussed below, other changes include two threaded release pins 84 for insertion in corresponding threaded passages 86 in the housing 20'. In addition, a modified tapered slot 24' includes a pocket 88 along opposed walls 90 of the modified tapered slot 24'. The pocket 88 is best seen in FIGS. 11 and 12.

As the retaining spring 36' is inserted into the tapered slot 24', a distal portion of the spring 36' passes over tips 84*a* of the release pins 84, until the tips 84*a* of the release pins 84 extend into the spring apertures 80, locking the slotted leaf 34' in the housing 20'. In order to subsequently remove the slotted leaf 34' from the housing 20', the release pins 84 are first unthreaded from the housing 20', and the slotted leaf 34' is slid out of the tapered slot 24'.

As best seen in FIGS. 11 and 12, the tapered slot 24' includes the pocket 88, dimensioned to receive the spring 36' when the slotted leaf 34' is drawn towards the wall 90, providing precise horizontal positioning of the slotted leaf 34.

A second embodiment of a horizontal hinge adjustment system for an adjustable hinge 12' is illustrated in FIGS. 13-16. The adjustable hinge 12' includes a receiver assembly 14', a stop plate 92 and a cover 22', collectively to be mounted to a door (not shown). The adjustable hinge 12' further includes a slotted leaf 34. The slotted leaf may be either of the above-described slotted leafs.

The hinge 12' includes a horizontal adjustment screw 94, preferably formed of stainless steel. The horizontal adjustment screw 94 is threaded into a threaded passage of a horizontal adjustment nut 96. The horizontal adjustment nut 96 is preferably formed of steel. As the horizontal adjustment screw 94 is rotated, the horizontal adjustment nut 96 moves axially along the horizontal adjustment screw 94. The horizontal adjustment nut 96 has a generally squared portion 96*a*, which fits into a complementarily shaped portion 14*a* in the receiver assembly 14', to prevent rotation of the horizontal adjustment nut 96.

The horizontal adjustment nut 96 includes a circumferential grooved portion 46 to receive the leaf slot 38' in the door leaf 34.

Figure 13:
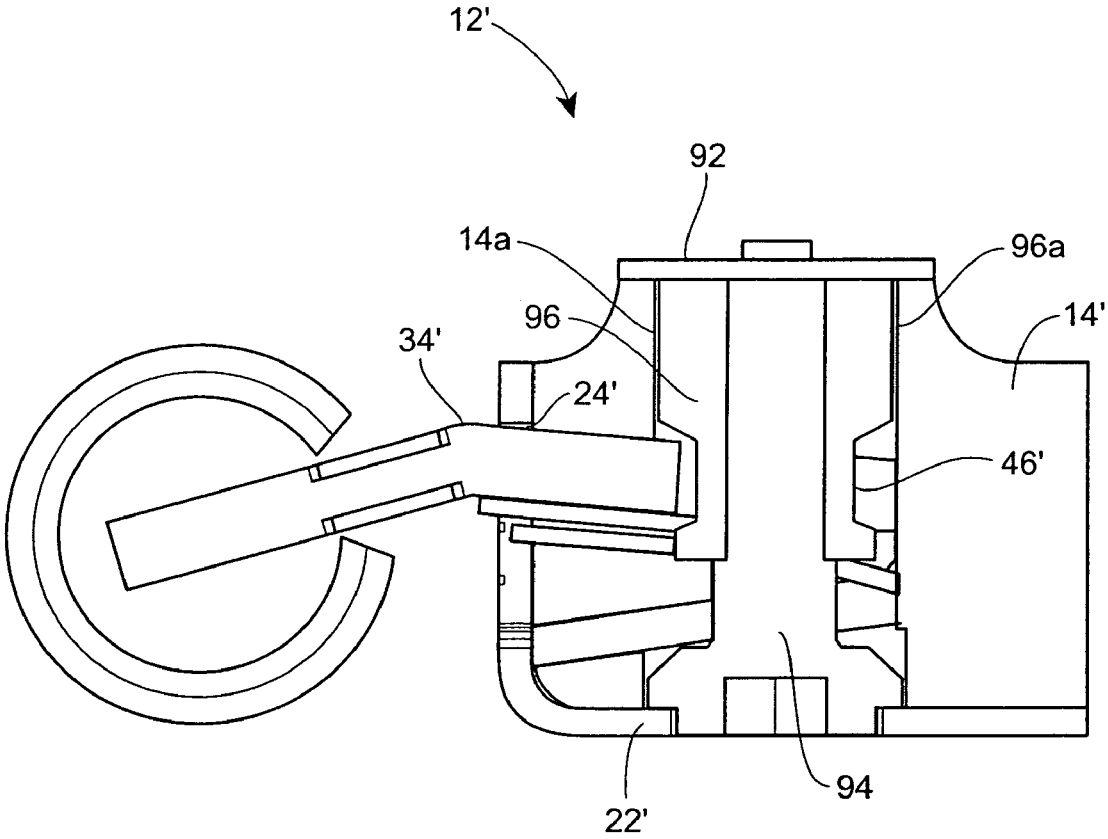
FIG. 13 is a sectional view of a hinge having an alternative arrangement for horizontally adjusting the hinge.
Figure 14:
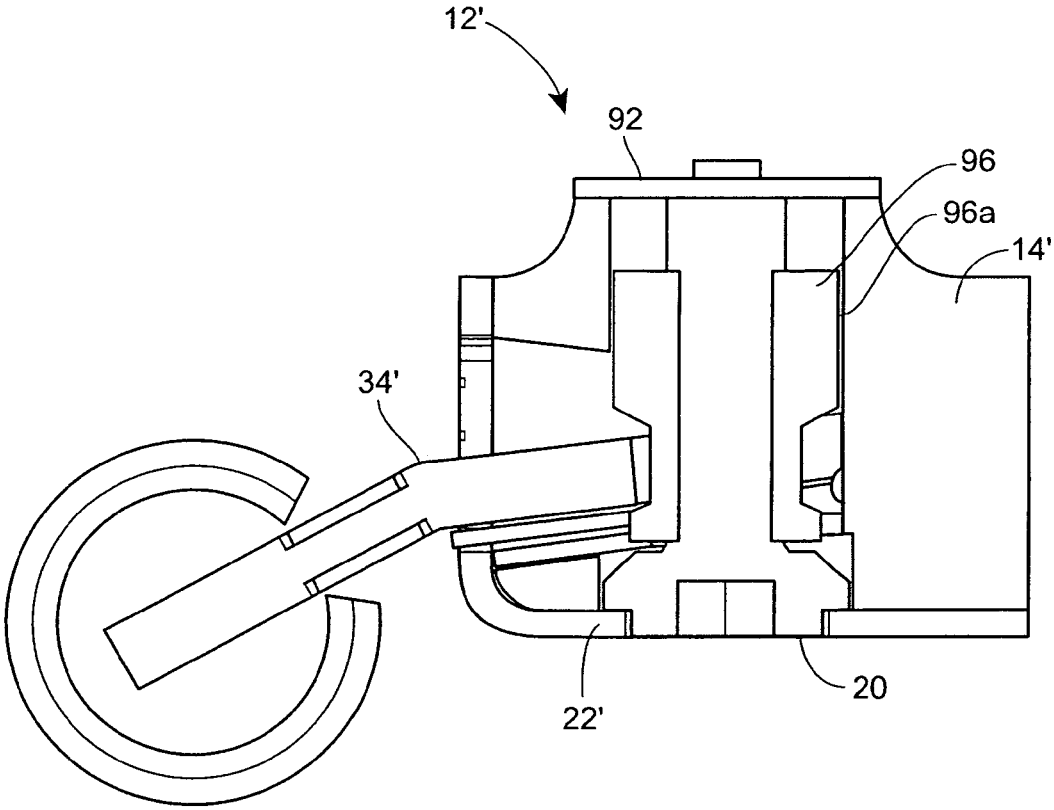
FIG. 14 is a further sectional view of the embodiment of FIG. 13.
Figure 15:
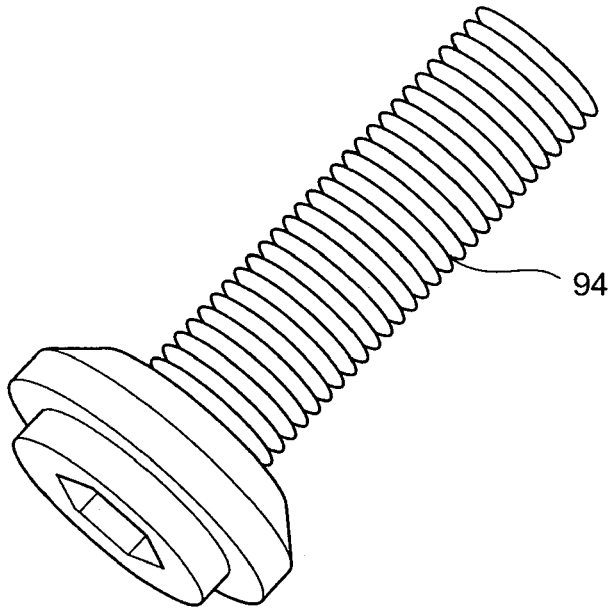
FIG. 15 is a perspective view of an adjustment screw as used in the embodiment of FIG. 13.
Figure 16:
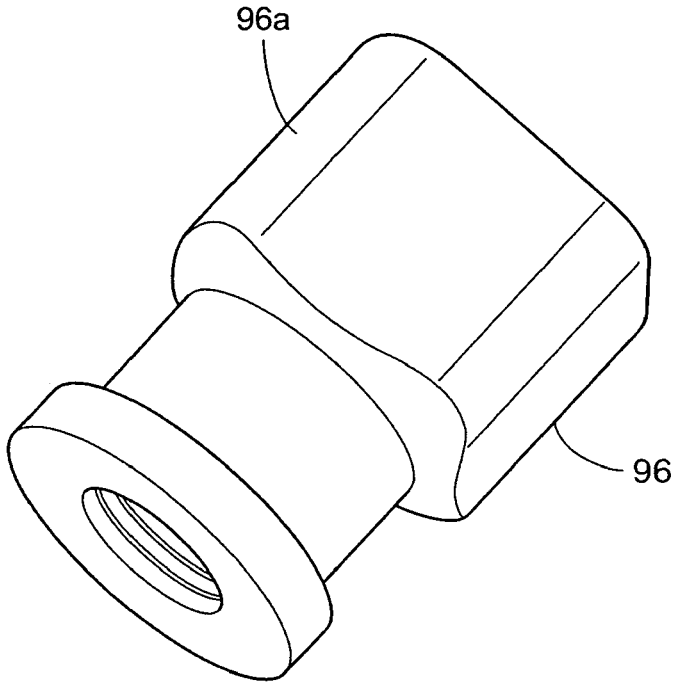
FIG. 16 is a perspective view of an adjustment nut as used in the embodiment of FIG. 13.

Rotation of the horizontal adjustment screw 94 in a first direction moves the door leaf 34' to a first horizontal position, as shown in FIG. 13. Rotation of the horizontal adjustment screw 94 in a second, opposite direction moves the door leaf 34' to a second horizontal position, as shown in FIG. 14.

The groove in the adjustment nut and the slot of the slotted leaf are sized to minimize play between the components during adjustment. The centerline of the slot of the slotted leaf and the centerline of the adjustment nut will be coincident in the nominal position.

The horizontal positioning feature and the vertical positioning feature can be implemented in a single hinge. Alternatively, a hinge may include only one of the features. It is believed to be more desirable to the end consumer to utilize, in a three hinge system, horizontally adjustable hinges as the upper and lower hinges, and a vertically adjustable hinge as the center hinge.

If a hinge only includes the vertical adjustment feature, no horizontal adjustment screws are required. To cover the opening for the adjustment screw, a cover solid at that location can be provided.

What is claimed is:

1. A hinge for a door comprising:

a receiver assembly having a slot and at least one bore;

a door leaf having a retaining spring extending away from the door leaf, the door leaf being dimensioned for insertion into the slot, the retaining spring having at least one spring aperture;

a retaining device associated with the receiver assembly for releasably engaging the retaining spring to releasably retain the door leaf in the slot, the retaining device comprising at least one pin releasably extending through the at least one bore to releasably engage the at least one spring aperture; and a second leaf pivotably connected to the door leaf.

2. The hinge of claim 1 wherein the slot is tapered.

3. The hinge of claim 1 wherein:

the at least one spring aperture comprises a plurality of spring apertures;

the at least one bore comprises a plurality of bores; and the at least one pin comprises a plurality of pins releasably extending through respective ones of the plurality of receiver assembly bores to releasably engage respective ones of the plurality of spring apertures.

4. The hinge of claim 1 wherein the at least one pin and the at least one bore are cooperatively threaded.

5. A hinge for a door comprising:

a receiver assembly having a slot and a cover having a slotted opening providing access to the slot;

a door leaf having a retaining spring extending away from the door leaf, the door leaf being dimensioned for insertion into the slot, the door leaf being inserted into the slot through the slotted opening, the slotted opening being dimensioned smaller than a cross-sectional area of the slot;

a retaining device associated with the receiver assembly for releasably engaging the retaining spring to releasably retain the door leaf in the slot, wherein the retaining spring is movable between a compressed position and an expanded position and is dimensioned to engage the cover when in the expanded position and to disengage from the cover when in the compressed position; and a second leaf pivotably connected to the door leaf.

6. The hinge of claim 5 wherein the retaining spring has an exposed tab to facilitate movement of the spring from the expanded position to the compressed position.

7. A hinge for a door comprising:

a receiver assembly having a slot;

a door leaf having a retaining spring extending away from the door leaf, the door leaf being dimensioned for insertion into the slot, the retaining spring having a spring aperture;

a retaining device associated with the receiver assembly for releasably engaging the retaining spring to releasably retain the door leaf in the slot, the retaining device comprising a projection connected to the receiver assembly and extending into the slot, the projection being received in the spring aperture to releasably engage the spring; and a second leaf pivotably connected to the door leaf.

8. A hinge for a door comprising:

a receiver assembly having a cavity therein;

a first leaf received within the cavity;

a retaining spring connected to the first leaf and extending away from the first leaf, the retaining spring having at least one spring aperture;

a retaining device associated with the receiver assembly, the retaining device releasably engaging the retaining spring to releasably retain the first leaf in the cavity, wherein the retaining device comprises at least one projection connected to the receiver assembly and extending into the cavity, the at least one projection being received in the at least one spring aperture to releasably engage the spring; and a second leaf pivotably connected to the first leaf.

9. The hinge of claim 8 wherein the cavity comprises a tapered slot having the first leaf received therein.

10. The hinge of claim 8 wherein the at least one projection is formed by at least one pin releasably extending through at least one bore in the receiver assembly to releasably engage the spring.

11. The hinge of claim 8 wherein:

the receiver assembly has at least one bore; and the projection comprises at least one pin releasably extending through the at least one bore to releasably engage the at least one spring aperture.

12. The hinge of claim 8 wherein:

the at least one spring aperture comprises a plurality of spring apertures;

the receiver assembly has a plurality of bores; and the at least one projection comprises a plurality of pins releasably extending through respective ones of the plurality of receiver assembly bores to releasably engage respective ones of the plurality of spring apertures.

13. A hinge for a door comprising:

a receiver assembly having a cavity therein and a cover having an opening providing access to the cavity;

a first leaf received within the cavity, the first leaf being inserted into the cavity through the opening, the cover having a flange surrounding at least a portion of the opening;

a retaining spring connected to the first leaf and extending away from the first leaf, wherein the retaining spring is movable between a compressed position and an expanded position;

a retaining device associated with the receiver assembly, the retaining device releasably engaging the retaining spring to releasably retain the first leaf in the cavity, wherein the retaining device comprises a portion of the flange, wherein the portion of the flange is configured to engage the spring when the spring is in the expanded position and to disengage the spring when the spring is in the compressed position; and a second leaf pivotably connected to the first leaf.

14. The hinge of claim 13 wherein the retaining spring has an exposed tab to facilitate movement of the spring from the expanded position to the compressed position.

15. The hinge of claim 14 wherein the opening has a slot, the exposed tab of the retaining spring received in the slot to facilitate access to the tab.

* * * * *